US005934533A

United States Patent [19]

Callanan

[11] Patent Number: 5,934,533

[45] Date of Patent: Aug. 10, 1999

[54] APPARATUS FOR RELEASABLY CARRYING RECREATIONAL EQUIPMENT

[76] Inventor: Megan H. Callanan, P.O. Box 9251, Newport Beach, Calif. 92658

[21] Appl. No.: 09/020,075

[22] Filed: Feb. 6, 1998

[51] Int. Cl.[6] ..... A45F 3/04

[52] U.S. Cl. ..... 224/651; 224/250; 224/627; 224/917

[58] Field of Search ..... 224/191, 627, 224/645, 650, 651, 654, 655, 658, 235, 236, 259, 261, 262, 263, 917, 250; D3/254, 261

[56] References Cited

U.S. PATENT DOCUMENTS

| | | | |
|---|---|---|---|
| 3,473,712 | 10/1969 | Genchi | 224/236 X |
| 4,858,797 | 8/1989 | Rabska | 224/651 X |
| 4,982,883 | 1/1991 | Ullal et al. | 224/651 |
| 5,092,506 | 3/1992 | Bolduc . | |
| 5,163,550 | 11/1992 | Hawk | 224/917 X |
| 5,341,973 | 8/1994 | Dawes et al. | 224/196 |
| 5,492,254 | 2/1996 | Challoner et al. . | |
| 5,647,522 | 7/1997 | Routh | 224/651 |
| 5,676,296 | 10/1997 | Masters | 224/651 X |

FOREIGN PATENT DOCUMENTS

| | | | |
|---|---|---|---|
| 612489 A1 | 8/1994 | European Pat. Off. | 224/917 |

OTHER PUBLICATIONS

Shorty's, Inc., *the Packs—Skate* (catalog), visited on Apr. 9, 1998, <http://shortysinc.com/skatepacks.html>.

Shorty's, Inc. *the Packs—Snowboard* (catalog), visited on Apr. 9, 1998 <http://shortysinc.com/snowpacks.html>.

*Primary Examiner*—Gregory M. Vidovich

*Attorney, Agent, or Firm*—Seed and Berry LLP

[57] ABSTRACT

An apparatus for releasably retaining a recreational board, such as a skateboard, snowboard or skis, is shown and described. In one embodiment, the apparatus has a main body with a front portion to which one or more straps is attached, and a rear portion to which a pair of opposing flaps is attached. The flaps extend from the main body such that the second flap overlaps the first flap when the two are wrapped in opposite directions around the recreational board. The overlapping surfaces of the two flaps are secured together to releasably retain the board. A connector is fixed to the second flap and extends from the rear portion of the carrier to the front portion of the carrier where it terminates in a grip. A force exerted on the grip subjects the connector to tension, causes the second flap to be separated from the first flap, and releases the board. In another embodiment, the connector extends through apertures in the front and rear portions of the main body. In still another embodiment, the connector extends through both the apertures and a tubular sleeve that is either attached to or incorporated within the strap.

13 Claims, 5 Drawing Sheets

APPARATUS FOR RELEASABLY CARRYING RECREATIONAL EQUIPMENT

TECHNICAL FIELD

The invention is directed to carriers and, more particularly, to over the shoulder carriers such as slings or backpacks for carrying recreational boards.

BACKGROUND OF THE INVENTION

Countless numbers of individuals ski, skateboard, snowboard, or otherwise utilize some form of board for recreation, exercise, or travel. When it is actually being used, the board is an integral part of the individual's activity. When it is not being used, however, the board often becomes a burden. For example, when a person goes to the mountains, that person's trip from the car to the lodge or lift is considerably more difficult with skis or a snowboard in hand than it would have been without. Similarly, when a skateboarder enters an area where skateboarding is not allowed, for instance a mall, getting around and conducting business is difficult with a loose board.

Consequently, ski bags and snowboard bags have been designed with straps. Backpacks have been used to hold small boards, or have been modified to incorporate rings, straps, or mesh to hold equipment to the outside surface. Clips have been designed to hold skis together while at the same time having a loop or strap to throw over a shoulder. Special carriers have even been invented for carrying a skateboard over one or both shoulders, particularly, U.S. Pat. No. 5,492,254 to Challoner et al., and U.S. Pat. No. 5,092,506 to Bolduc. These devices have various shortcomings.

Ski and snowboard bags and ski clips successfully carry the equipment but, once at the mountain, become a burden of their own. Placing equipment in a backpack increases the risk that valuables also contained in the pack will be lost every time the board is inserted or removed. The patented skateboard carriers do not carry anything substantial other than the skateboard itself and, like the first bags discussed, become baggage when the board is in use. Most importantly, none of the above devices allows for quick and easy removal of the board when desired for use. Instead, each of them must first be removed, the zipper, straps, clips or other fasteners manipulated by hand, and then the device put back on (or worse yet, stored somewhere) before the board can be ridden.

A need therefore exists for an improved carrier for recreational boards.

SUMMARY OF THE INVENTION

It is therefore an object of this invention to provide an improved carrier for recreational boards.

In one embodiment of the invention, a carrier having a main body and at least one strap is provided. The strap can be a waist strap, or one or two shoulder straps. The carrier has a front portion that corresponds to the portion of the main body closest to the person wearing the carrier, and a rear portion that corresponds to the portion of the main body opposite the front portion. The carrier also has a base portion and a side portion, together forming the chamber of a backpack.

The strap is attached to the front portion of the main body. The rear portion is fitted with a pair of flaps for holding the recreational board against the outside surface of the main body. Each of the two flaps has one edge permanently attached to the main body. When the free ends of the two flaps are separated, one or more boards may be placed between them. The flaps may then be wrapped around opposing sides of the board, with the second flap overlapping the first flap on the side of the board opposite the main body. The overlapping flaps hold the board to the carrier and are held together with releasable, re-usable fasteners, such as snaps, hooks and loops, or other means for securing the flaps.

A connector is sewn or otherwise fixed to the second flap. The connector can be cord, string, rope, chain, cable, or any equivalent connector. The connector is long enough to extend from the second flap, when the second flap is retaining a board, to a point far enough past the main body where it can be easily reached by the wearer. The connector may have a grip on its free end.

The grip is maintained close to the wearer by passing the connector through a loop, carabiner, or similar device, or by feeding it through the handle. The grip hangs from the retaining device close to the wearer for easy access. If the board is retained on the carrier and the wearer desires to ride it, the wearer merely pulls on the grip. The tension in the connector separates the two flaps, thereby releasing the board. Because the board can be easily released with one hand, the wearer's free hand can hold the board when it is being released.

In another embodiment, the rear portion of the main body is additionally fitted with a first aperture and the front portion of the main body is additionally fitted with a second aperture. The first aperture is positioned on the side of the second flap opposite the first flap. Consequently, tension in the connector from the direction of the first aperture pulls the second flap away from the first flap, separating the two flaps, and releasing the board. By selecting a connector of the proper length, the grip can hang from the second aperture in a position that is easy for the wearer to access.

In another embodiment, a flexible, tubular sleeve is attached to the strap. After extending through the two apertures described above, the connector is then extended through the sleeve to a point near the wearer's hip. This allows the grip to be positioned even closer to the wearer's hand. The sleeve has an inside diameter slightly larger than the connector so that the connector can slide easily through the sleeve. For comfort reasons, the sleeve should preferably be on the side of the strap away from the wearers body.

In still another embodiment, the strap is made up of a top layer and a bottom layer. The top layer can be made from nylon webbing or a material having similar strength and flexibility characteristics, and has a third orifice at a point intermediate the strap. The bottom layer is either nylon webbing or padding. Instead of being fixed to the strap, in this embodiment a flexible, tubular sleeve is positioned between the two layers of the strap and runs along the length of the strap from a point inside the main body to the third orifice. The connector extends through the tubular sleeve and out the third orifice. The grip is permanently retained close to the wearer's hand for easy access.

DETAILED DESCRIPTION OF THE INVENTION

Figure 1:
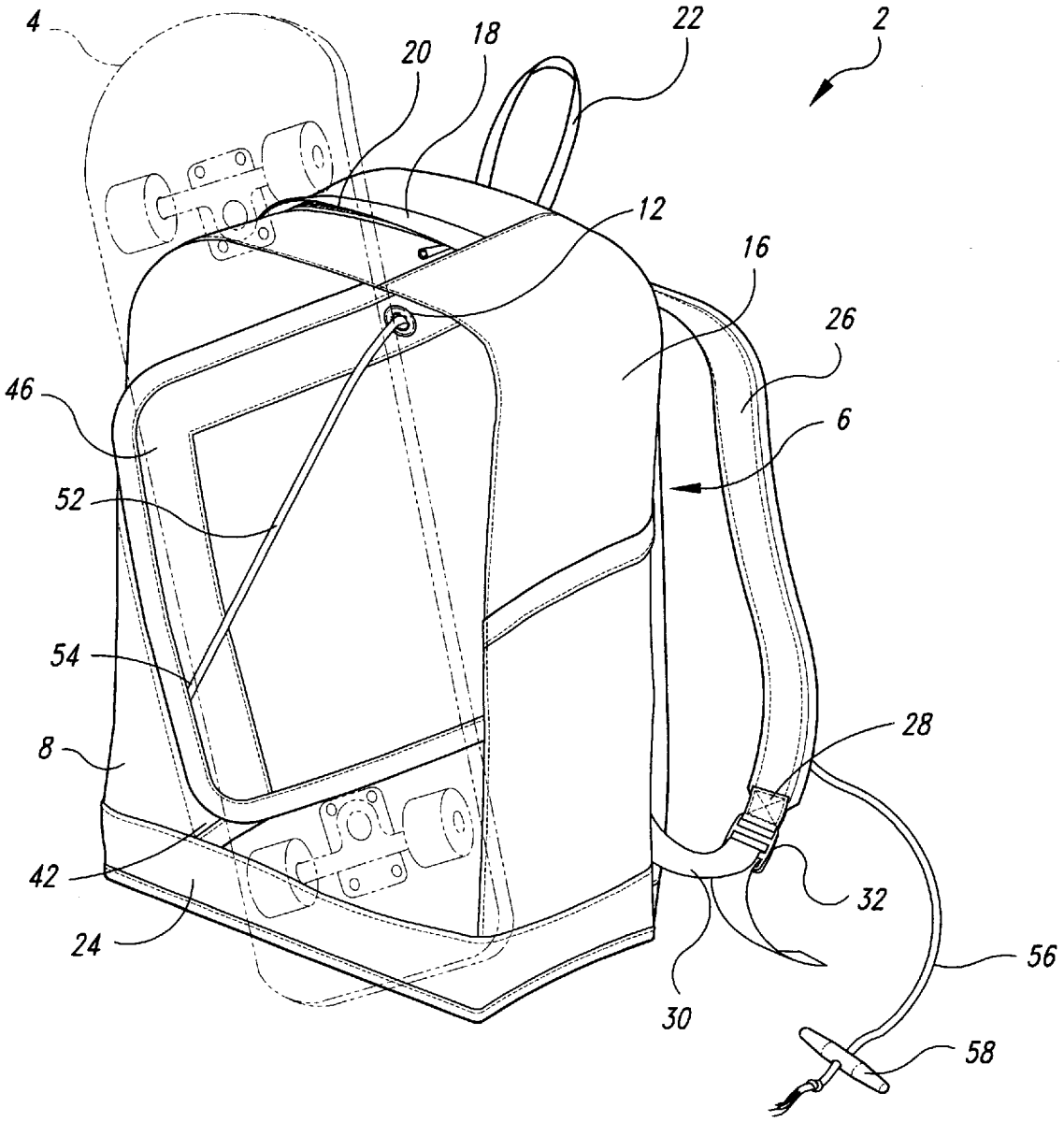
FIG. 1 is a perspective view of a first embodiment of the present invention.
Figure 2:
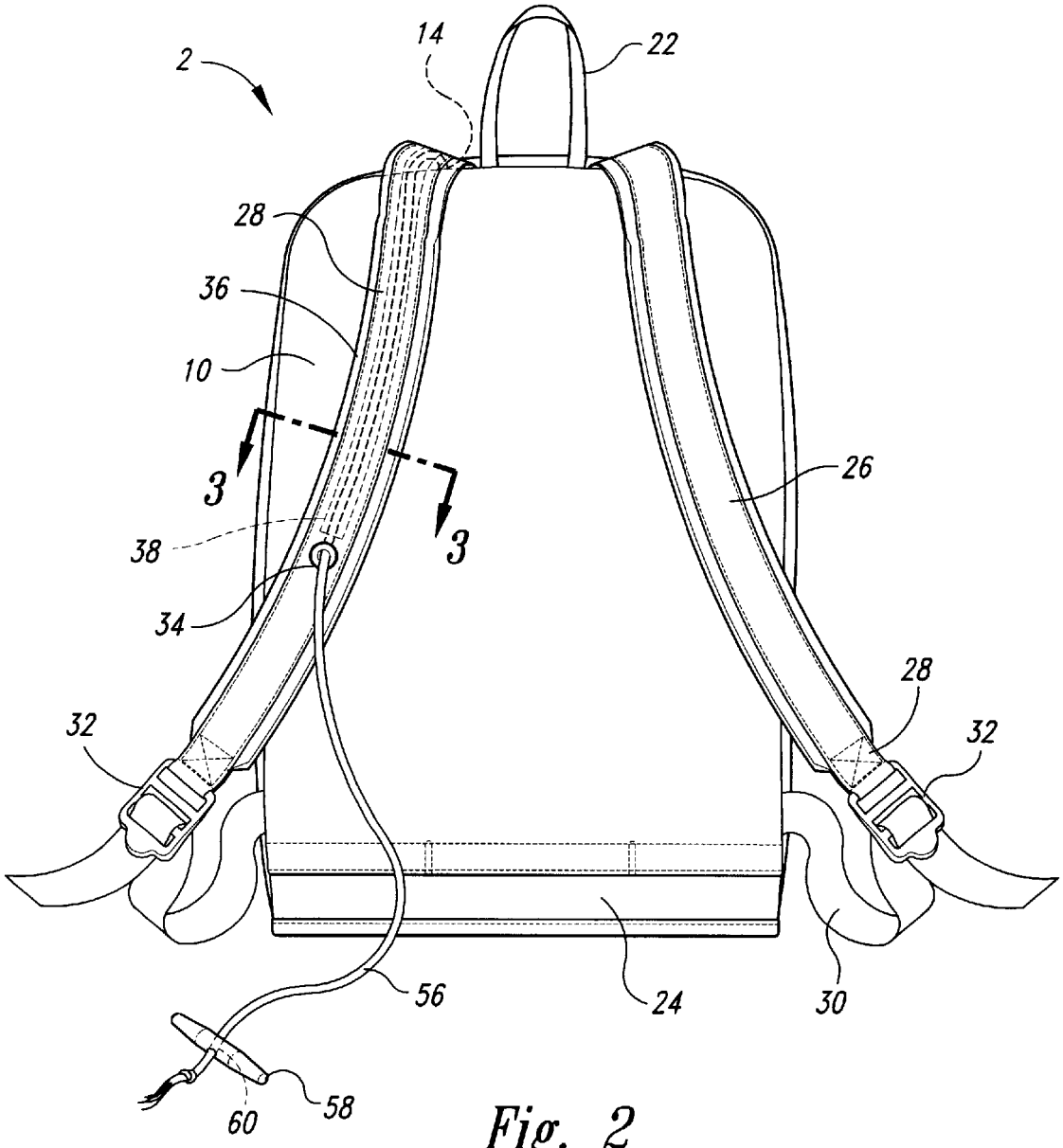
FIG. 2 is a plan view of the front portion of a first embodiment of the present invention.
Figure 3:
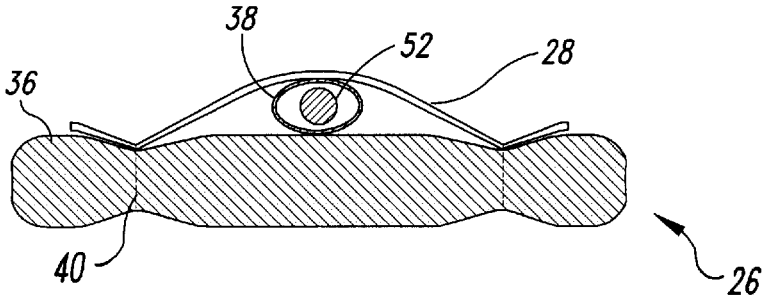
FIG. 3 is a sectional view of section 3—3 as defined in FIG. 2.

FIGS. 1–3 show a carrier 2 for releasably retaining a recreational board 4 according to a first embodiment of the present invention. The carrier 2 is supported by one or more straps 26. On the back of carrier 2, a board 4 is held by a first flap 42 and a second flap 46. The board 4 is released when the wearer pulls a grip 58, causing the connector 52 to separate the second flap 46 from the first flap 42.

The carrier 2 has a main body 6 having a rear portion 8 that corresponds to the portion of the main body 6 farthest from the person wearing the carrier 2. The rear portion 8 has a first aperture 12. The carrier 2 also has a front portion 10 that corresponds to the portion of the main body 6 closest the wearer. The front portion 10 has a second aperture 14.

The carrier 2 can be made from nearly any material that is light enough to be worn by a person, such as wood, plastic, foam, etc., although the carrier 2 is preferably made from a strong, flexible material, such as nylon or leather. In a preferred embodiment, the carrier 2 is hollow, allowing the carrier 2 to hold not only a board 4, but to also carry other articles. A side portion 16 can be inserted between the rear portion 8 and the front portion 10 in order to give the carrier 2 more volume. Side portion 16 extends about the perimeter of the front portion 10 and rear portion 8, forming the walls of a chamber.

An elongated opening 18 can be incorporated in carrier 2 to allow the wearer to access the internal chamber of the main body 6. In the exemplary embodiment, the opening 18 is located in side portion 16. The opening 18 can be alternatingly sealed and opened using a zipper 20, or any other fastening method known in the arts.

The main body 6 is also shown having a handle 22 and a base portion 24. Handle 22 is provided at the top of main body 6 to give an individual an alternate means of picking up the carrier 2. To extend the life of the carrier 2, the base portion 24 can be reinforced with canvas, leather, or any material having similar properties.

The first aperture 12 in rear portion 8 penetrates through the material of rear portion 8 and is large enough for a small connector to pass through, approximately ⅛" to ¾" in diameter. The first aperture 12 can be reinforced by stitching, with a grommet, or through other means generally known in the art. In the exemplary embodiment, the first aperture 12 is positioned in the upper right corner when the carrier 2 is viewed from the rear, although the first aperture 12 can be positioned almost anywhere within the rear portion 8.

One method of wearing the carrier 2 is by extending an arm through a strap 26. In the exemplary embodiment, carrier 2 has two straps 26, each of which combines a first webbing strip 28 and a second webbing strip 30. The first webbing strip 28 and the second webbing strip 30 are each attached at one terminal end to the front portion 10 of the main body 6. The distal, free ends of the strips are adjustably attached by a buckle 32, or any other adjustable connecting means recognized in the art. First webbing strip 28 and second webbing strip 30 are made from nylon webbing which is light-weight, flexible and strong, although any material having similar qualities can be substituted.

In the exemplary embodiment, the first webbing strip 28 is fixed at a point near the top of the main body 6 and the second webbing strip 30 is attached to the front portion 10 at the lower end of the main body 6. These positions can be moved as understood in the art to satisfy various structural needs and customer demands. The first webbing strip 28 has a third aperture 34 placed intermediate its length.

A strip of padding 36 can be sewn or otherwise attached to the first webbing strip 28 to make the carrier 2 more comfortable for the wearer. The padding 36 and the first webbing strip 28 are connected along their longitudinal edges by stitching 40, or through any other attaching means known in the art. In the exemplary embodiment, the padding 36 is slightly narrower than the first webbing strip 28, causing the first webbing strip 28 to buckle, creating a longitudinal gap in the strap 26. The padding 36 extends from the terminal end of the first webbing strip 28 that engages the main body 6 to a point intermediate the first webbing strip 28. The padding 36 extends far enough to make the carrier 2 comfortable to the wearer, preferably to a point that corresponds to somewhere between the wearer's armpit and hip. In the exemplary embodiment., the padding extends slightly beyond the third aperture 34.

A substantially tubular sleeve 38 is positioned within the longitudinal gap between the padding 36 and the first webbing strip 28. The tubular sleeve 38 extends from the terminal end of the strap 26 that engages the main body 6, to a point near the third aperture 34. In the exemplary embodiment, the tubular sleeve 38 terminates slightly before reaching the third aperture 34, and has an inside diameter slightly larger than a nylon connector, or approximately ⅛" to ¼." The tubular sleeve 38 is made from a material that is flexible, that will not pinch or buckle when bent, and that is strong enough not to collapse when compressed between the padding 36 and the first webbing strip 28.

As described above, the strap 26 is permanently attached at one terminal end to the front portion 10 of the main body 6 at a point near the second aperture 14. As also described above, the terminal end of the strap 26 in the exemplary embodiment comprises the first webbing strip 28, the padding 36, and the tubular sleeve 38. When the strap 26 is attached, the tubular sleeve 38 protrudes through the second aperture 14 and terminates within the main body 6. In an alternate embodiment, the strap 26, including the tubular sleeve 38, is inserted in the seam between the front portion 10 and the side portion 16 during fabrication of the main body 6.

Figure 4A:
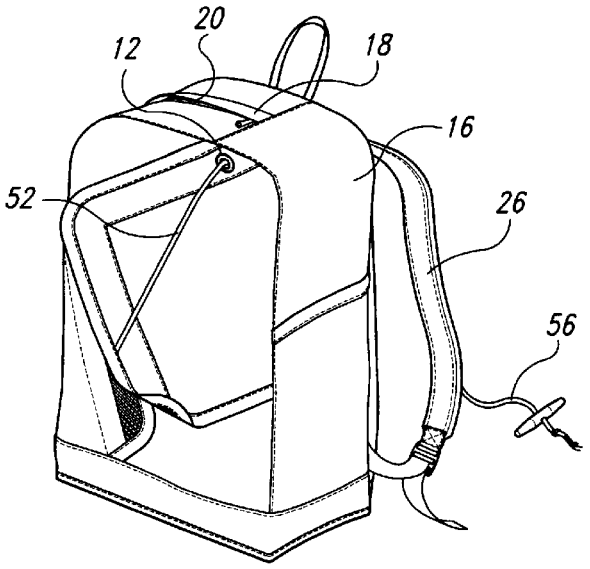
FIG. 4A–C are perspective view s of the rear portion of a first embodiment of the present invention, detailing the progression of the carrier releasing an article.
Figure 4B:
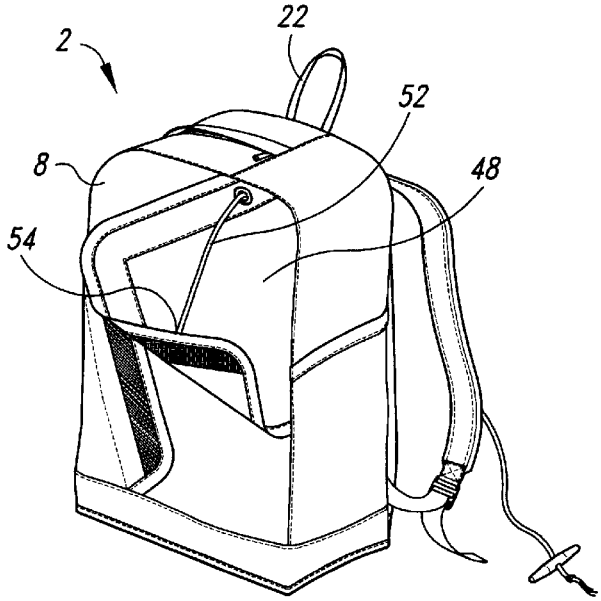
Figure 4C:
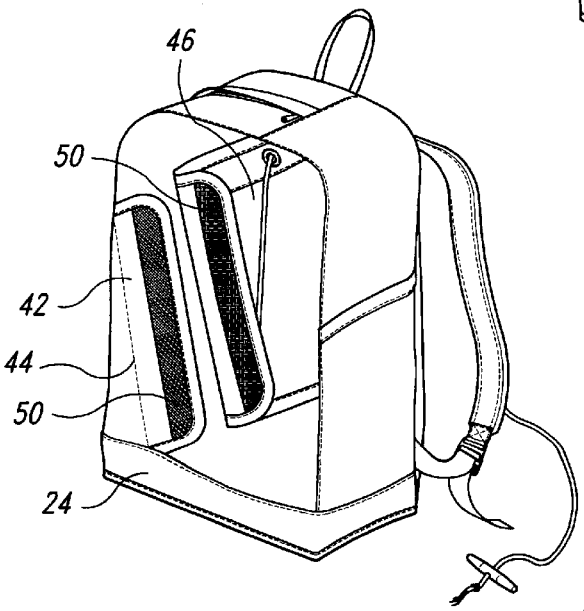

FIGS. 4A–4C show two generally opposing flaps, a first flap 42 having a first edge 14, and a second flap 46 having a second edge 48. These flaps engage to releasably retain the board 4 against the outside surface of the main body 6. The first edge 44 and the second edge 48 are permanently attached to the rear portion 8 of the main body 6. In the exemplary embodiment, the first edge 44 is separated from and roughly parallel to the second edge 48, although many different variations and orientations will serve the purpose of the invention.

When the free ends of the two flaps are separated, one or more boards 4 may be placed between them. The flaps may then be wrapped around the board 4 in opposing directions, with the second flap 46 overlapping the first flap 42 on the side of the board opposite the main body 6. The overlapping flaps are held together with a releasable, reusable securing means 50, such as snaps or hooks and loops, and thereby hold the board 4 to the carrier 2. It is noted that the hooks may be placed on either of the flaps and the loops will be placed on the other of the flaps.

A connector 52 having a first end 54 and a second end 56 is sewn or otherwise fixed at its first end 54 to the second flap 46. The connector 52 is long enough to extend from the second flap 46, when the second flap 46 is retaining a board 4, to a point far enough past the main body 4 where it can be easily reached by the wearer. The connector 52 terminates at its second end 56 in a grip 58 or other handling aid, such a knot. In the exemplary embodiment, the grip 58 comprises a fourth aperture 60 through which the second end 56 of the connector 52 extends. A knot in the connector 52 prevents grip 58 from slipping off of the second end 56 of the connector 52, as would any number of retaining means known in the art. The connector 52 can be made from nylon, as in the preferred embodiment, or from hemp, cable, chain, or any other equivalent means of translating a tensile force.

When the wearer desires to ride a board 4 that is at the time retained by the carrier 2, the wearer merely pulls on the grip 58 and the second flap 46 is separated from the first flap 42, releasing the board 4. Because the board 4 can be easily released with one hand, the wearer's free hand can hold the board 4 when it is being released, preventing the board 4 from falling onto the ground.

Figure 5:
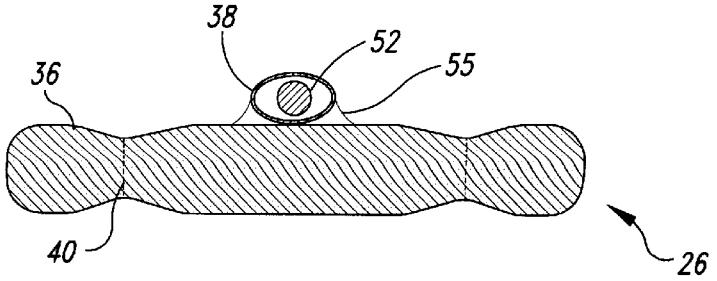
FIG. 5 is a sectional view of the strap of a second embodiment of the present invention.

FIG. 5 shows a detail distinguishing a second embodiment of a carrier 2 for recreational boards 4 according to the present invention. This embodiment is intended for original manufacture as well as for being retrofitted to existing carriers 2. The tubular sleeve 38 is attached external to the strap 26 by an adhesive 55 or other fastener. Consequently, this embodiment functions without the need for a special strap. The connector 52 is extended from the second flap 46, through both the first aperture 12 and the second aperture 14, then through the tubular sleeve 38 to a point where the second end 56 of the connector 52 and the grip 58 are within easy reach of the wearer.

Figure 6:
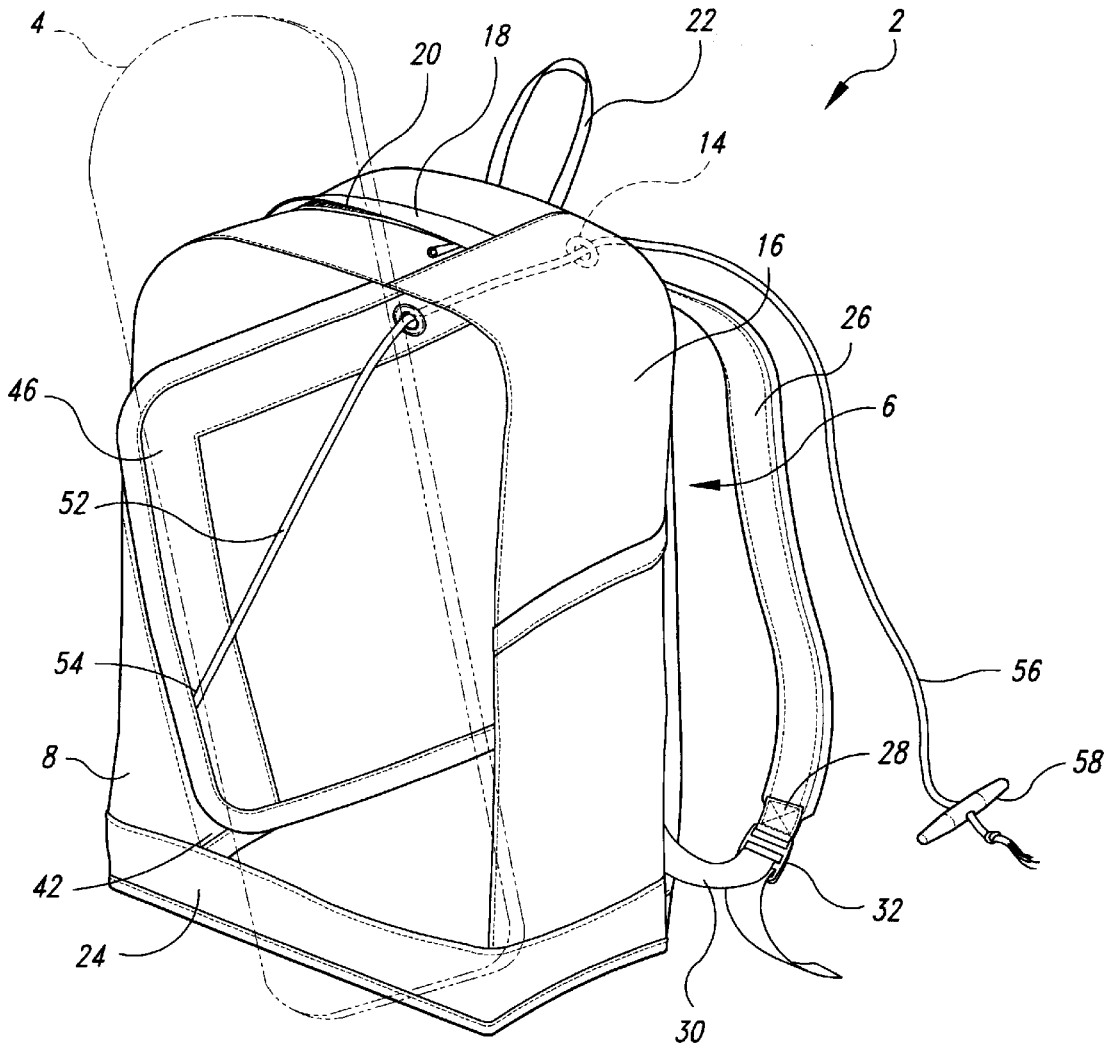
FIG. 6 is a perspective view of a third embodiment of the present invention.

FIG. 6 shows a carrier 2 for a recreational board 4 according to a third embodiment of the present invention. The connector 52 extends from the second flap 46 through both the first aperture 12 and the second aperture 14. This embodiment does not require any retrofitting of the strap 26. Off the shelf carriers 2 can be retrofitted by merely cutting apertures in the front and rear panels.

In the exemplary embodiment, the second aperture 14 is positioned toward the top of the front portion 10 of the main body 6, although other orientations can be substituted. The connector 52 extends from the second flap 46, through the first aperture 12 and the second aperture 14, then hangs freely from the second aperture 14 to a point where the grip 58 is within easy reach of the wearer.

Figure 7:
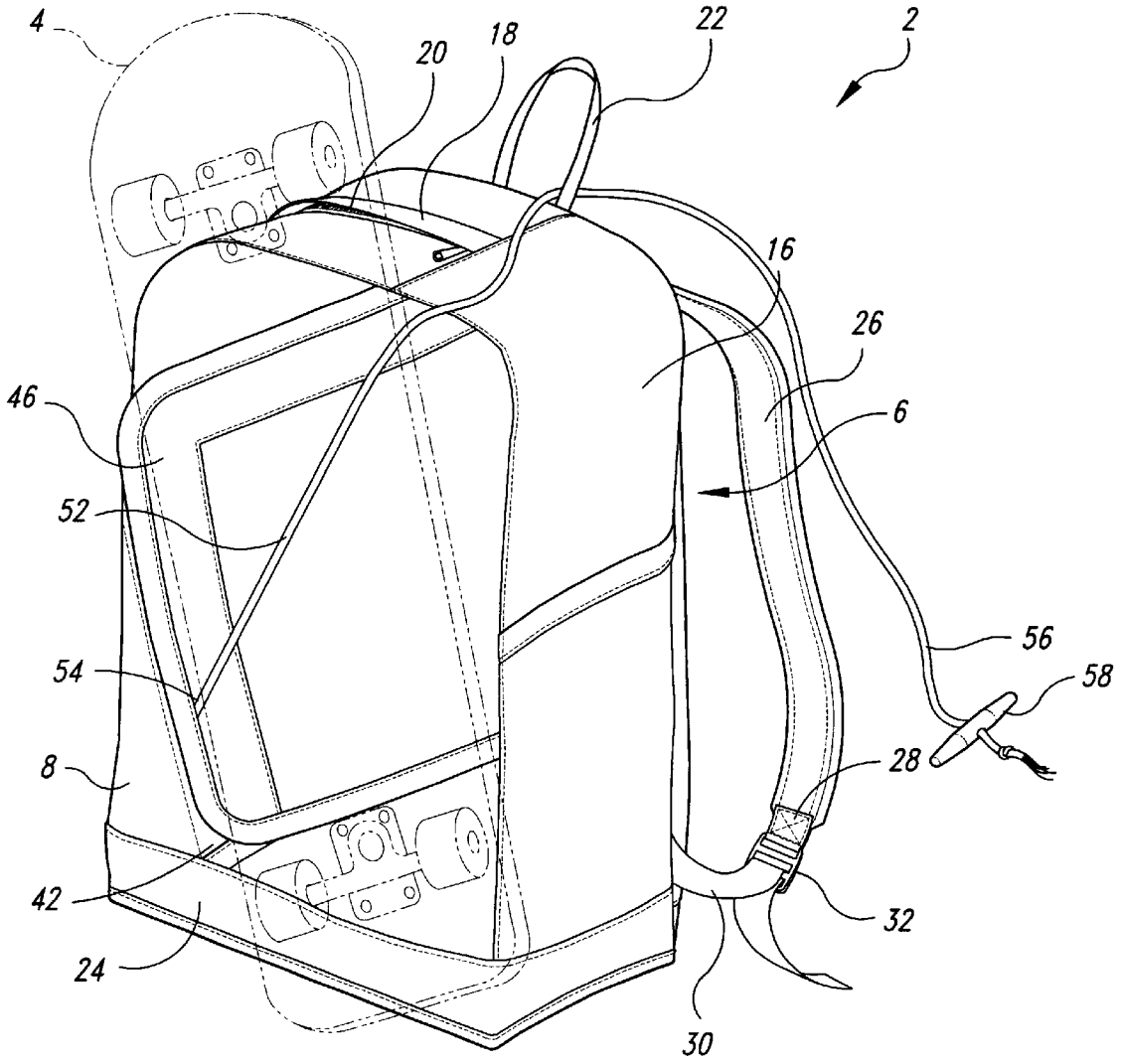
FIG. 7 is a perspective view of a fourth embodiment of the present invention.

FIG. 7 shows a carrier 2 for a recreational board 4 according to a fourth embodiment of the present invention. This embodiment is the most versatile, and can be retrofitted to any carrier 2 without cutting holes in the material. The connector 52 is attached to the second flap 46, and is long enough to wrap around or over the main body 6 and extend to a point near the wearer's hip. The grip 58 may be maintained accessible to the wearer by passing the connector 52 through the handle 22, or through a loop, carabiner, or similar device known in the art.

Although a limited number of embodiments of the invention have been illustrated and described, various alternatives, modifications and equivalents may be used. Therefore, the foregoing description should not be taken as limiting the scope of the inventions which are defined by the appended claims.

I claim:

1. An apparatus comprising:

a main body comprising a rear portion having a first aperture and a front portion having a second aperture;

at least one strap having its terminal ends attached to the front portion of the main body;

a first flap having a first edge that is attached external to the rear portion of the main body such that the first flap is free to pivot about the first edge;

a second flap having a second edge that is attached external to the rear portion of the main body such that the second flap is free to pivot about the second edge, the first flap and the second flap extending such that a first contacting surface on the first flap contacts a second contacting surface on the second flap when the two flaps are wrapped around an article being carried;

a securing means fixed to the first and second contacting surfaces such that the flaps are selectively releasably engaged; and a connector having a first end and a second end, the first end fixed to the second flap, the length of the connector extending through the first aperture and the second aperture such that the second end of the connector is on the opposite side of the main body from the first end whereby a force exerted on the second end of the connector causes the second flap to be separated from the first flap and releases the article from the carrier.

2. The apparatus according to claim 1 wherein the front portion and the rear portion of the main body are separate, and wherein the main body further comprises a base portion and a side portion attached between the perimeters of the front and rear portions whereby a chamber is formed.

3. The apparatus according to claim 1, further comprising a grip near the second end of the connector.

4. The apparatus according to claim 1 wherein one terminal end of the strap engages the upper end of the front portion of the main body and the opposing terminal end of the strap engages the lower end of the front portion of the main body.

5. An apparatus according to claim 1 further comprising a tubular sleeve fixed longitudinally to the strap, a first end of the sleeve protruding through the second aperture and terminating within the main body, a second end of the sleeve terminating intermediate the strap, and the length of the connector further extending through the sleeve.

6. The apparatus according to claim 1 wherein the strap further comprises an elongated first webbing strip being fixed at a first terminal end to the front portion of the main body, an elongated second webbing strip being fixed at a first terminal end to the front portion of the main body at a point separate from the point of attachment of the first webbing strip, and a buckling means whereby the free end of the first webbing strip adjustably engages the free end of the second webbing strip.

7. An apparatus according to claim 6 wherein:

the first webbing strip further comprises a third aperture;

the strap further comprises an elongated strip of padding, the padding and the first webbing strip connected along their complementary longitudinal edges, the padding extending from the first terminal end of the first webbing strip to slightly beyond the third aperture, and the padding being slightly narrower than the first webbing strip whereby a longitudinal gap is formed between the padding and the first webbing strip;

the apparatus further comprising a tubular sleeve having an internal diameter slightly larger than the diameter of the connector, the sleeve extending longitudinally within the longitudinal gap from the first terminal end of the strap to a point near the third aperture; and the first webbing strip being fixed to the front portion of the main body such that the sleeve protrudes through the second aperture and terminates within the main body, and the length of the connector further extending through the sleeve and through the third aperture.

8. The apparatus according to claim 1 wherein the first edge and the second edge are spaced from each other.

9. The apparatus according to claim 8 wherein the first edge and the second edge are separated by a distance slightly greater than the width of the article being carried.

10. The apparatus according to claim 8 wherein the first edge and the second edge are substantially parallel.

11. The apparatus according to claim 1 wherein the securing means attached to the first flap includes a plurality of hooks, and the securing means attached to the second flap includes a complementary plurality of loops.

12. The apparatus according to claim 1 wherein the securing means attached to the first flap includes a plurality of loops, and the securing means attached to the second flap includes a complementary plurality of hooks.

13. An apparatus comprising:

a main body comprising a rear portion having a first aperture and a front portion having a second aperture;

at least one strap having its terminal ends attached to the front portion of the main body;

a tubular sleeve extending longitudinally from a point near a first of said terminal ends of the strap to a point intermediate the strap;

a first flap having a first edge that is attached external to the rear portion of the main body such that the first flap is free to pivot about the first edge;

a second flap having a second edge that is attached external to the rear portion of the main body such that the second flap is free to pivot about the second edge, the first flap and the second flap extending from the rear portion such that a first contacting surface on the first flap contacts a second contacting surface on the second flap when the two flaps are wrapped in opposite directions around an article being carried;

a securing means attached to the first and second contacting surfaces such that the flaps are selectively releasably engaged; and a connector having a first end and a second end, the first end of the connector being fixed to the second flap, the length of the connector extending through the first aperture, through the second aperture, and through the sleeve such that a force exerted on the second end of the connector causes the second flap to be separated from the first flap and releases the article from the carrier.

* * * * *